United States Patent [19]

Callari

[11] Patent Number: 4,938,728

[45] Date of Patent: Jul. 3, 1990

[54] MAGNET ACTUATED FLOATING RUNG NOVELTY LADDER

[76] Inventor: Daniel T. Callari, 252 Wabash Ave., Kenmore, N.Y. 14217

[21] Appl. No.: 419,943

[22] Filed: Oct. 11, 1989

[51] Int. Cl.[5] ..... A63H 33/26

[52] U.S. Cl. ..... 446/133; 272/8 R

[58] Field of Search ..... 446/131–135, 446/129; 273/1 M; 272/8 N, 8 R; 40/426

[56] References Cited

U.S. PATENT DOCUMENTS 2,693,788 11/1954 Spatz ..... 272/8 N X 3,550,936 12/1970 Puttick ..... 446/129 X

FOREIGN PATENT DOCUMENTS 1278328 6/1972 United Kingdom ..... 446/133

*Primary Examiner*—Mickey Yu

*Attorney, Agent, or Firm*—H. Jay Spiegel

[57] ABSTRACT

The present invention relates to an improved novelty device resembling a ladder. The device includes a base having rung guides located thereon. Spaced between the rung guides and above the base are a plurality of rungs having magnets located in the ends of each rung. The magnets and rung guides are arranged such that the rungs may freely travel between the rung guides, the rungs being separated by the repulsive forces of the magnets.

11 Claims, 2 Drawing Sheets

MAGNET ACTUATED FLOATING RUNG NOVELTY LADDER

BACKGROUND OF THE INVENTION

The present invention relates to an improved novelty device resembling a ladder wherein the rungs of the ladder are spaced by the repulsive forces of magnets. In the prior art, novelty devices utilizing magnets are known. U.S. Pat. No. 4,486,729 to Lee and U.S. Pat. No. 2,961,796 to Davis are examples of such novelty devices. However, applicant is unaware of any prior art that includes all of the features of the present invention including a novelty device resembling a ladder wherein the rungs of the ladder are unevenly spaced by the repulsive forces of magnets.

SUMMARY OF THE INVENTION

The present invention relates to an improved novelty device. The present invention includes the following interrelated aspects and features:

(a) In a first aspect, the improved novelty device resembling a ladder includes a base, a pair of rung guides supported by the base and having channels therein and a plurality of rungs having magnets at the ends of the rungs, the ends of the rungs being located in the channels of the rung guides.

(b) The magnets in the ends of the rungs are arranged such that similar poles of the magnets are adjacent to each other such that adjacent rungs repel each other by the repulsive forces of the magnets therein. The base may also contain magnets to repel a rung adjacent to the base.

(c) The rungs and the base of the improved novelty device may also include as a part thereof magnetic pole extenders which extend the magnetic poles of the magnets such that magnets having a lesser thickness may be utilized in the present invention.

Accordingly, it is a first object of the present invention to provide a new and improved novelty device.

It is a further object of the present invention to provide a new and improved novelty device resembling a ladder having unevenly spaced rungs.

It is a yet further object of the present invention to provide an improved novelty device resembling a ladder wherein the rungs of the ladder are spaced by the repulsive forces of magnets placed therein.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
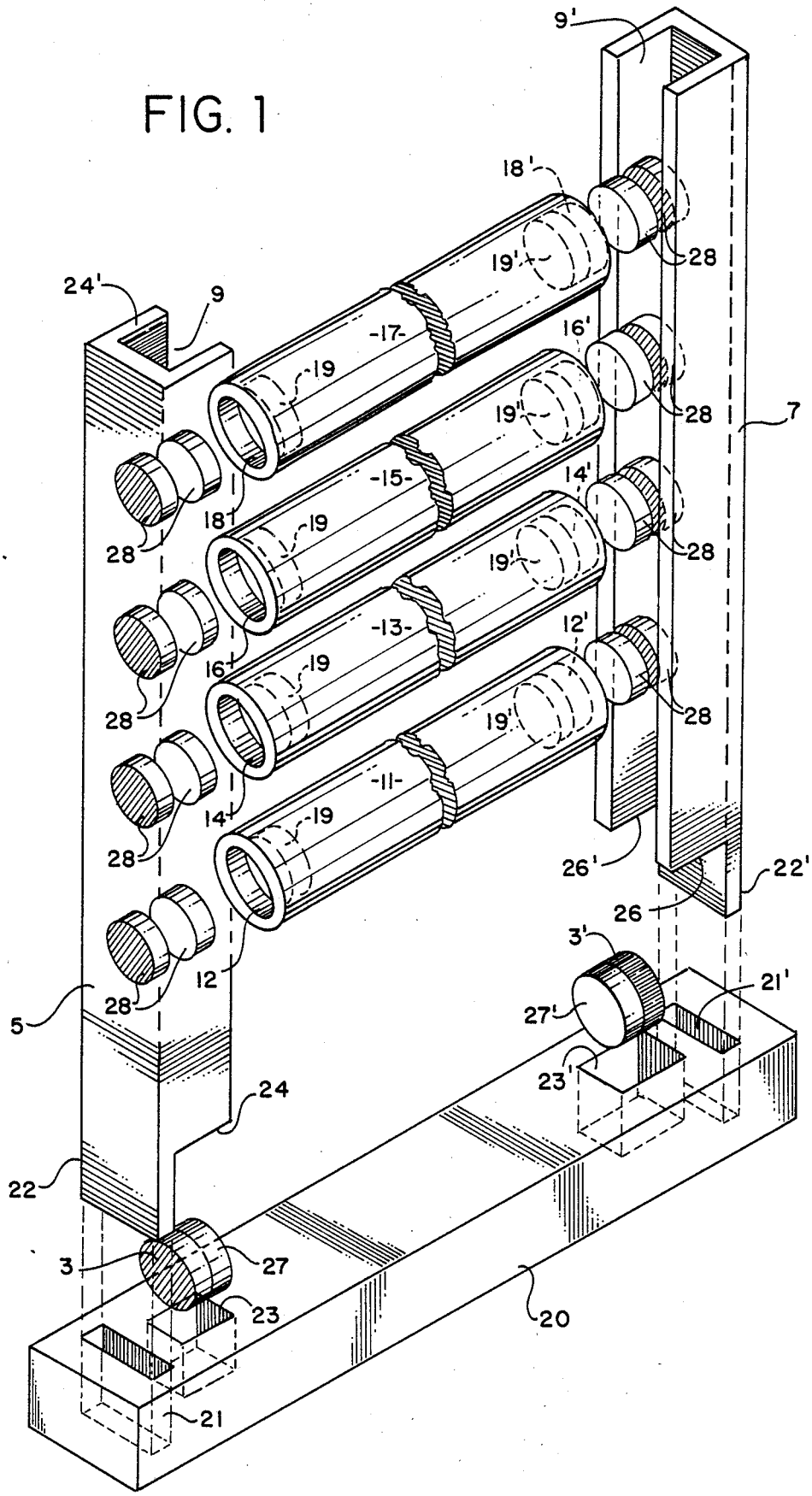
FIG. 1 shows an exploded view of the novelty device of the present invention.

With reference to FIG. 1 firstly, an exploded view of the improved novelty item is generally designated by reference numeral 10 and is seen to include a base 20, rungs 11, 13, 15 and 17, and rung guides 5 and 7. The base 20 has openings 21 and 21' therein for receiving rung guides 5 and 7. The base also has openings 23 and

23, for receiving magnets 3 and 3, and magnetic pole extenders 27 and 27'.

Rungs 11, 13, 15 and 17 have recesses 12, 12', 14, 14', 16, 16', 18, 18' in each end, each recess adapted to retain a magnet 28 (shaded). The rungs also have recesses 19 and 19' which are adapted to receive magnetic pole extenders 28 (unshaded).

Rung guides 5 and 7 are shown as a three piece assembly, rung guide 5 having end portion 22 with side portions 24 and 24'. Rung guide 7 has end portions 22, and side portions 26 and 26'. End portions 22 and 22' of rung guides 5 and 7 are designed to fit into openings 21 and 21' of base 20 such that base 20 supports rung guides 5 and 7.

Rung guides 5 and 7 each have a channel 9 and 9', which is configured to receive and guide the rungs 11, 13, 15 and 17 in a vertical plane above the base 20.

Figure 2:
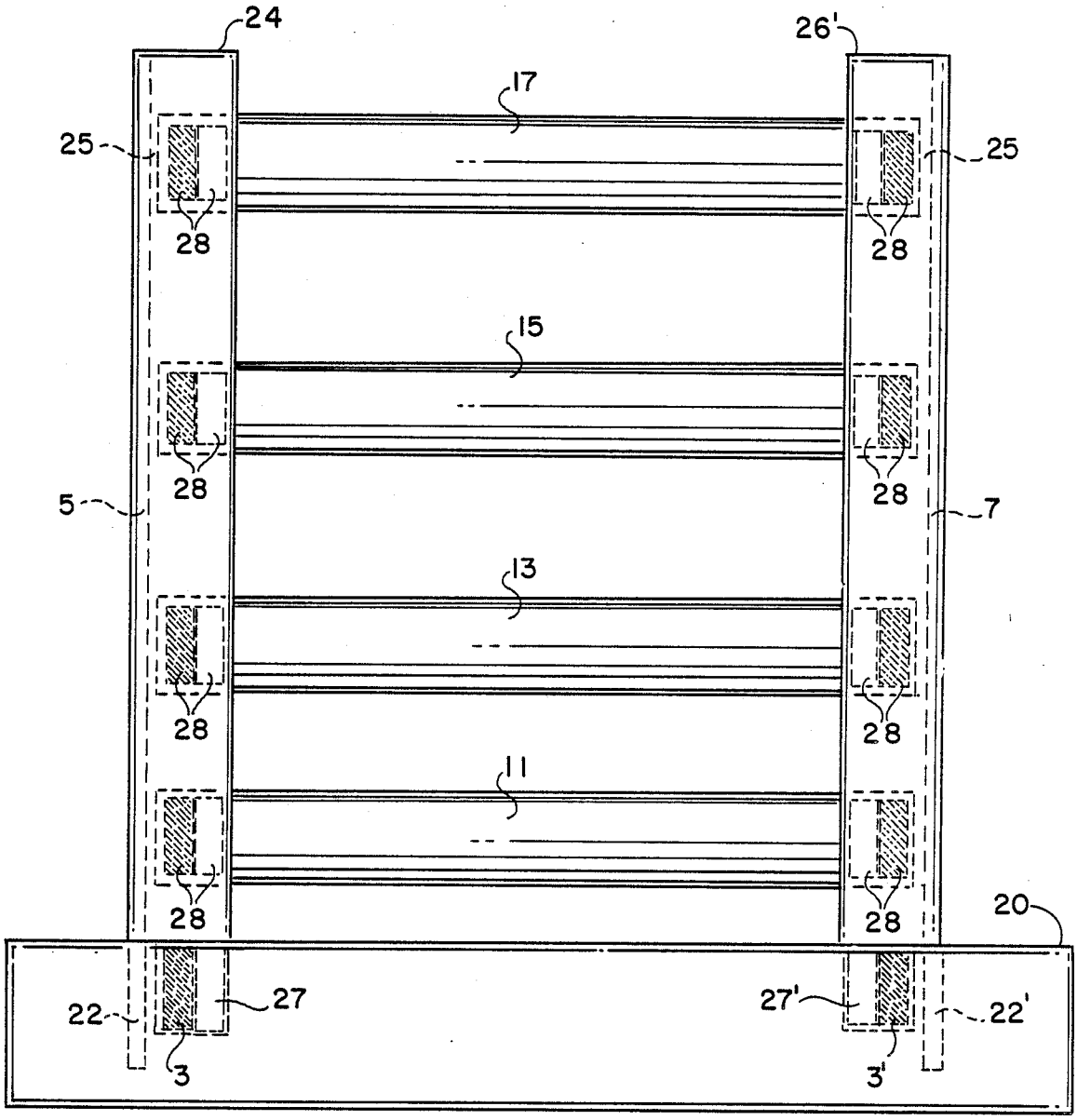
FIG. 2 shows a front view of the improved novelty device of the present invention.

FIG. 2 shows a front view of the novelty device illustrating the device assembled. As can be seen from the drawing, the distance between rung guides 5 and 7 is greater than the length of the rungs 11, 13, 15, and 17 creating a gap 25 such that the rungs may freely travel in the channels 9 and 9' of the rung guide 5 and 7. In operation, the magnets 28 and (shaded) are placed in the base and recesses of the rungs such that adjacent magnets have similar poles adjacent to each other. By having the similar poles adjacent each other, the magnets repel each other and maintain a spacing between adjacent rungs as well as between the base and the rung adjacent thereto.

In another embodiment, the rungs may contain a single magnet therein, whereby adjacent magnets would be arranged such that a spacing would be maintained between rungs. Alternatively, the rungs themselves may be magnets, the magnets arranged such that similar poles would be adjacent each other to maintain the requisite spacing.

The magnets may be made of any magnetic material but a preferred material would include a rare earth type magnet such as an iron-neodymium-boron magnet. The magnets should be of sufficient strength to maintain a spacing between the rungs of the novelty device.

The base, rung guides and rungs may be made out of any material. These materials may include wood, plastics, metals, or fiberglass. The rung guides may also be a one piece design or may be constructed of a plurality of rods, the rods being positioned vertically to form the channel to guide and retain the rungs. The base may have openings therein to correspond to each rod such that the rods are inserted into the appropriate openings thereby forming the channel.

The base portion may be designed such that it acts only to support the rung guides and does not contain any magnets. In this embodiment, the first rung of the ladder would rest on the base with the other rungs being spaced therefrom. This type of base need not have openings therein for receiving magnets or magnetic pole extenders.

Magnetic pole extenders 27, 27' and 28 (unshaded) may be made of any permeable material that acts to extend the poles of the magnets along the axis of the rungs. The magnetic pole extenders act to extend the magnetic poles of the magnets such that magnets with a smaller thickness may be inserted into the base and rungs. An example of a preferred permeable material would be iron or an iron alloy.

The effect of placing all the rungs in the same vertical plane separated only by the magnetic forces of the magnets is a ladder having unevenly spaced rungs, rungs closely spaced at the bottom of the device with rungs having an increased spacing between them at the top of the device.

The improved novelty device of the present invention gives the appearance of a ladder with unevenly spaced rungs which may be placed on a desk or table as a decorative item or a conversation piece. The rungs may be pressed down and released such that they bounce back up to the original position.

As such, an invention has been disclosed in terms of a preferred embodiment thereof which fulfills each and every one of the objects as set hereinabove and provides a new and improved novelty device of great utility and novelty.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. An improved novelty device resembling a ladder comprising:
   (a) a base;
   (b) a pair of rung guides supported by said base, each one of said rung guides having a channel therein;
   (c) a plurality of rungs, each end of each respective one of said rungs having an opening therein, each respective one of said rungs being arranged between said pair of rung guides such that each end of each one of said rungs fits into a respective said channel of each respective rung guide;
   (d) a plurality of magnets, each magnet being mounted in a said opening;
   (e) wherein vertically adjacent magnets are arranged with similar magnetic poles adjacent each other such that adjacent rungs are separated by magnetic repulsive forces, thereby creating spaces between said rungs.

2. The invention of claim 1, wherein said base has a pair of further openings therein, each said opening having a further magnet therein, each one of said further magnets and each vertically adjacent rung magnet being arranged with similar magnetic poles adjacent each other such that said base and a vertically adjacent rung are separated by magnetic repulsive forces, thereby creating a space between a said rung and said base.

3. The invention of claim 1 wherein each said opening of each respective said rung also contains a magnetic pole extender.

4. The invention of claim 3, wherein each said magnetic pole extender comprises a permeable material.

5. The invention of claim 1, wherein said base includes a pair of recesses therein, each one of said recesses being configured to receive a portion of a respective said rung guide for supporting each of said rung guides on said base.

6. The invention of claim 1, wherein each of said rung guides comprises a plurality of rods.

7. The invention of claim 6, wherein said base includes a plurality of recesses, each said recess being configured to receive a portion of a respective said rod for supporting one of said rung guides on said base.

8. An improved novelty device resembling a ladder comprising:
   (a) a base;
   (b) a pair of rung guides supported by said base, each one of said rung guides having a channel therein;
   (c) a plurality of rungs, each one of said rungs having an opening therein, each one of said rungs being arranged between said rung guides such that each end of each one of said rungs fits into a respective said channel of each one of said rung guides;
   (d) a plurality of magnets, each magnet being mounted in a said opening;
   (e) wherein vertically adjacent magnets are arranged with similar magnetic poles adjacent each other such that adjacent rungs are separated by magnetic repulsive forces, thereby creating spaces between said rungs.

9. The invention of claim 8, wherein said base has a further opening therein, said further opening having a further magnet therein, said further magnet and each vertically adjacent rung magnet being arranged with similar magnetic poles adjacent each other such that said base and a vertically adjacent rung as separated by magnetic repulsive forces, thereby creating a space between a said rung and said base.

10. An improved novelty device resembling a ladder comprising:
   (a) a base;
   (b) a pair of rung guides supported by said base, each one of said rung guides having a channel therein;
   (c) a plurality of cylindrical magnets, each cylindrical magnet resembling a rung, each end of each said cylindrical magnet being arranged between said rung guides such that each end of each rung fits into a respective channel of one of said rung guides;
   (d) wherein vertically adjacent magnets are arranged with similar magnetic poles adjacent each other such that adjacent cylindrical magnets are separated by magnetic repulsive forces, thereby creating spaces between said cylindrical magnets.

11. The invention of claim 10, wherein said base has an opening therein, said opening having a further magnet therein, said further magnet and each vertically adjacent cylindrical magnet being arranged with similar magnetic poles adjacent each other such that said base and a vertically adjacent cylindrical magnet are separated by magnetic repulsive forces, thereby forming a space between a said cylindrical magnet and said base.

* * * * *